US005807195A

United States Patent [19]

Westbrook

[11] Patent Number: 5,807,195

[45] Date of Patent: Sep. 15, 1998

[54] METHOD AND APPARATUS FOR BASKETBALL SHOOTING SKILL DEVELOPMENT

[76] Inventor: Franklin D. Westbrook, 9710 Woodland Dr., Silver Spring, Md. 20910

[21] Appl. No.: 743,043

[22] Filed: Nov. 4, 1996

[51] Int. Cl.[6] ..... A63B 69/00

[52] U.S. Cl. ..... 473/447

[58] Field of Search ..... 473/447, 479–484

[56] References Cited

U.S. PATENT DOCUMENTS

| | | | |
|---|---|---|---|
| 3,586,324 | 6/1971 | Bearson | 473/484 |
| 4,412,679 | 11/1983 | Mahoney et al. | 473/483 |
| 4,522,394 | 6/1985 | Broussard | 473/483 |
| 4,526,367 | 7/1985 | Haston et al. | 473/483 |
| 4,801,142 | 1/1989 | Friesen | 473/484 |
| 4,904,981 | 2/1990 | Mele et al. | 473/479 X |
| 4,999,603 | 3/1991 | Mele et al. | 473/479 X |
| 5,102,128 | 4/1992 | Geise | 473/483 |
| 5,342,041 | 8/1994 | Angulnek et al. | 473/447 X |
| 5,540,429 | 7/1996 | Dalebout et al. | 473/483 |
| 5,547,185 | 8/1996 | Wagner et al. | 473/483 |
| 5,603,495 | 2/1997 | Noveck | 473/447 |

FOREIGN PATENT DOCUMENTS

| | | | |
|---|---|---|---|
| 665898 | 10/1965 | Belgium | 473/100 |
| 2819659 | 11/1979 | Germany | 473/100 |
| 1006504 | 10/1965 | United Kingdom | 473/100 |

*Primary Examiner*—William H. Grieb
*Attorney, Agent, or Firm*—Jerome J. Norris

[57] ABSTRACT

A system for aiding basketball players to improve their skill at successfully shooting the basketball from any place on the basketball court, by application of the principle of successive approximation. The system incorporates a three piece floor mat that covers one half of a basketball court, and a height adjustable basketball goal mounted upon a wheeled frame. The mat maps the floor of the half court with equidistantly spaced semicircles so that the distance to the basket can be readily determined. The semicircles radiate from the center of an imaginary point falling directly under the hoop and extending to both the endline and the side lines of the court. The basketball goal may be raised or lowered to allow application of the successive approximation principle. The wheeled frame also serves to store and move the mat.

13 Claims, 7 Drawing Sheets

METHOD AND APPARATUS FOR BASKETBALL SHOOTING SKILL DEVELOPMENT

BACKGROUND OF THE INVENTION

1. Field of the Invention

The instant invention resides in the field of sports training equipment, particularly the sport of basketball.

2. Background of the Invention

The object of the game of basketball is to "shoot" a basketball, that is to say, put the basketball through a goal or basket more often than one's opponent in a given amount of time. For a regulation basketball court, the goal, also called a basket or simply "the hoop", is attached to a vertically standing planar surface known as a backboard and is positioned ten feet off the floor. One goal or basket is located at either end of the basketball court and one goal is provided for each of the opposing teams. The highest level of a basketball player's proficiency is represented by being able to shoot the basketball through the goal or basket from any location and from any distance on the basketball court. The invention 's method and apparatus raises the stand-shooting skill of a basketball trainee to a degree which approaches perfection. Stand-shooting is the act of throwing a basketball while standing in place, with both feet firmly planted on the floor.

In this respect, many training devices intended to improve the shooting skill of basketball players have been presented over the years.

One such training device is taught in U.S. Pat. No. 3,586,324 wherein the basketball goal involves upper and lower pivotable pairs of arms which allow the goal to be adjusted in height so as to permit children to develop proper playing skills. Unfortunately, the apparatus is both mechanically complicated and expensive, which are clearly conditions that put the apparatus out of the hands of children that need the training the most.

Therefore, there is a need for basketball training apparatus that allows a trainee to practice shooting the basketball until the trainee develops a muscular knowledge of the basketball court that is similar to the knowledge that musicians have of their musical instrument. There is also a need for a basketball training apparatus to have a design that enables a player to master the complex behavior of shooting a basketball accurately by application of the theory of successive approximations.

Successive approximations is a behavioral psychological principle which advocates rewarding a student for actions that approximate, but do not actually achieve, a final objective. As a training procedure, successive approximation guarantees skill acquisition and mastery by rewarding a trainee for behavior which is in the chain of behaviors that must be emitted when performing a target behavior, but before the target behavior is actually emitted. In the game of basketball, the target behavior is shooting the ball through the hoop from any position that a basketball player would normally expect to shoot the ball. A reward is offered by this invention when the ball actually goes through the hoop each time that the basketball is shot.

Since, the object of basketball is to score points by putting a basketball through the goal or basket more often than an opponent in a given amount of time, there is a yet further need for successful basketball players to learn how to accomplish this task from relatively distant points on the basketball court. Systematic practice that begins sufficiently close to the basket, because the trainee cannot miss getting the basketball through the goal or basket from a close distance, is the first application of a successive approximation principle. The trainee is rewarded both by getting the basketball into the basket and also by record keeping that will yield different rewards at a later time.

Finally, there is a need to provide a method and apparatus that overcomes the prior art arrangements for teaching basketball shooting skill by offering a basketball trainee the opportunity to practice shooting skills simply and with both minimum effort and maximum efficiency, while at the time not incurring unnecessary training costs or expenses.

SUMMARY OF THE INVENTION

One object of the invention is to provide a basketball shooting skill training device that is easy to use and inexpensive to purchase.

Another object of the invention is to provide a basketball shooting skill training device that uses the successive approximation principle.

A further object of the invention is to provide a basketball shooting skill training device that is effective and uncomplicated to use.

A yet further object of the invention is to provide a basketball shooting skill training device that easily adapts to improvement in the shooting skill of the basketball trainee.

A still further object of the invention is to provide a basketball shooting skill training device that is useful in training players of various heights.

An additional object of the invention is to provide a basketball shooting skill training device that is easy to store.

Another additional object of the invention is to provide a basketball shooting skill training device that offers positive reinforcement to the trainee.

A further additional object of the invention is to provide a basketball shooting skill training device that facilitates record keeping pertaining to basketball shooting skill improvement statistics.

A yet further additional object of the invention is to provide a basketball shooting skill training device that allows for self directed use while not requiring the assistance of a coach or trainer.

It is yet a further objective of the invention to provide a basketball shooting skill training device having an automatic height maintaining safety device.

A final object of the invention is to provide a basketball shooting skill training device that is useful to trainees of all ages, from childhood through adulthood.

Other advantages and objects of the invention will become apparent by reference to the Detailed Description of the Preferred Embodiment, when read in conjunction with the accompanying drawing figures wherein like numerals refer to like parts throughout.

DETAILED DESCRIPTION OF THE PREFERRED EMBODIMENT

Figure 1:
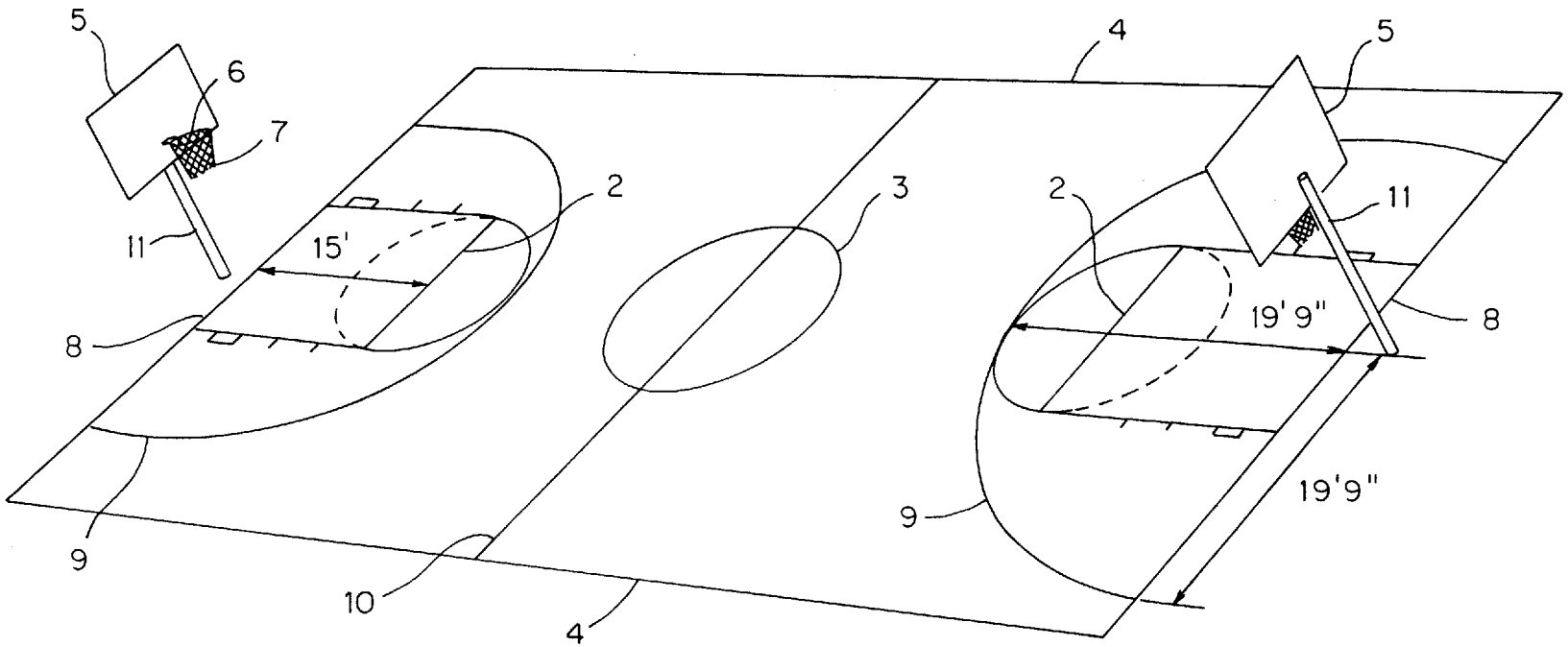
FIG. 1 shows a regulation basketball court.

FIG. 1 shows a rectangular basketball court 1 made of any wear resistant but firm material, including but not exclusively, hardwood, concrete, or synthetic surfaces, and laid out on a smooth planar surface. A backboard 5,5 is at each end of the basketball court which will serve as the goal for each of the two opposing teams. Each backboard 5,5 is respectively supported by stand 11, 11. Each stand 11, 11 is solidly affixed to the floor of the surface upon which the basketball court is laid. Each backboard 5,5 supports a circularly shaped hoop 6 comprising the goal or basket. Each hoop takes the form of a metal circle measuring 18 inches in diameter. Lining the perimeter of each hoop 6, 6 and suspended vertically therefrom, is a net 7, 7, respectively. The height of the hoop 6 is fixed at 10 feet from the surface of the court, and the hoop 6 measures eighteen inches in diameter. Each net 7, 7, respectively applies a frictionally created braking force to a basketball as the ball passes through the hoop 6. The court is bounded by sidelines 4,4 and endlines 8,8. The court is fifty feet wide, as measured from one sideline 4 to the other side line 4. The vertical plane of each backboard 5 lies along the same plane as the respective end line 8, 8. Thus, the hoop 6 held by each backboard 5 actually extends nine inches onto the basketball court. The center of the basketball court is denoted by a line 10, known as the division or center line, extending from one sideline 4, 4 to the other. The line 10 divides the court into two half courts. A circle 3 falls on the line 10, centrally, and is referred to as the center circle.

According to the rules of regulation play, each goal or basket successfully completed by a player earns two points for the team to which the hoop 6 belongs, with the following exceptions. If a player successfully completes a basket from or beyond the line 9, the team to which that goal belongs receives 3 points. The line 9, often referred to as the three point field goal line, is nineteen feet, nine inches at its apex from the goal, and nineteen feet nine inches center-to-center, measured along the base line 8. A line 2, referred to as the free throw line, falls fifteen feet from the hoop 6. A player successfully completing a goal from the line 2 earns only one point for his or her team. At regulation height, the hoop 6 is ten feet from the surface of the court 1.

Figure 2:
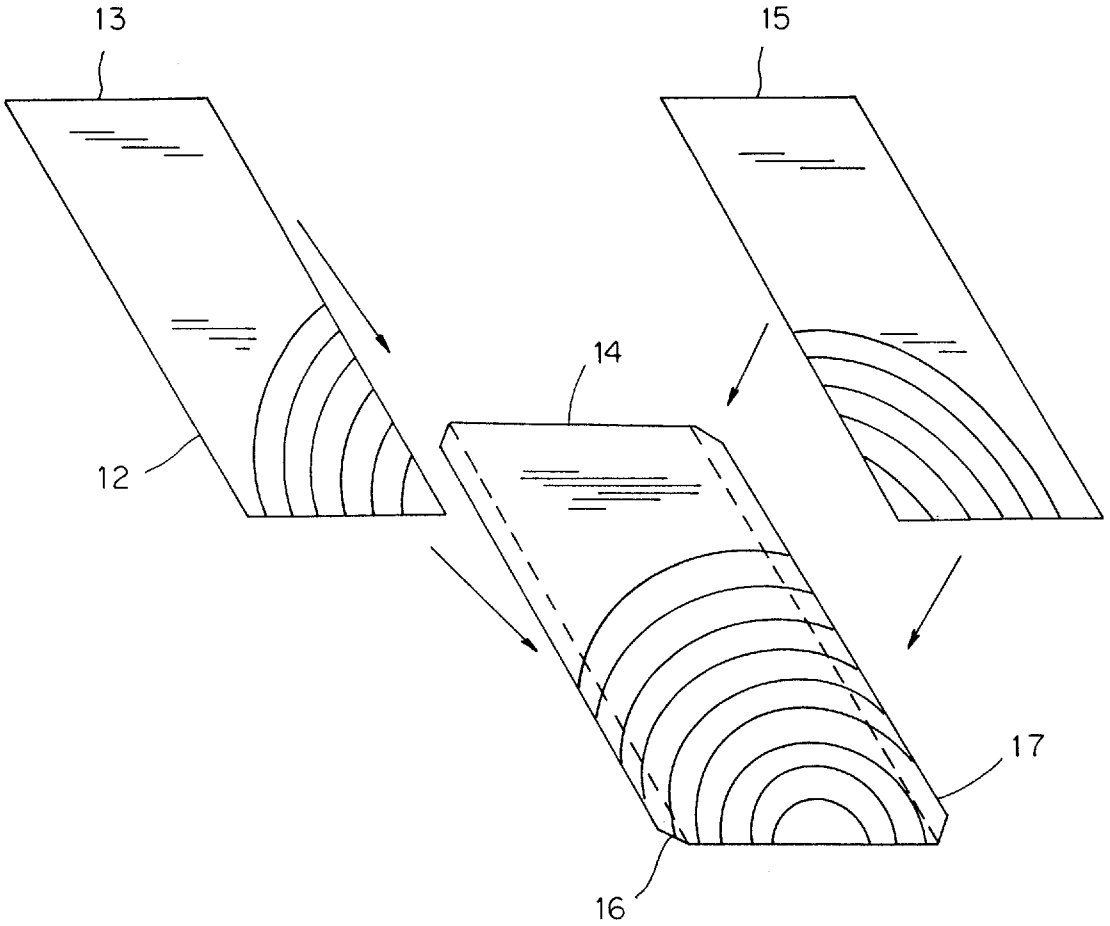
FIG. 2 shows an assembly view of invention's floor mat.
Figure 3:
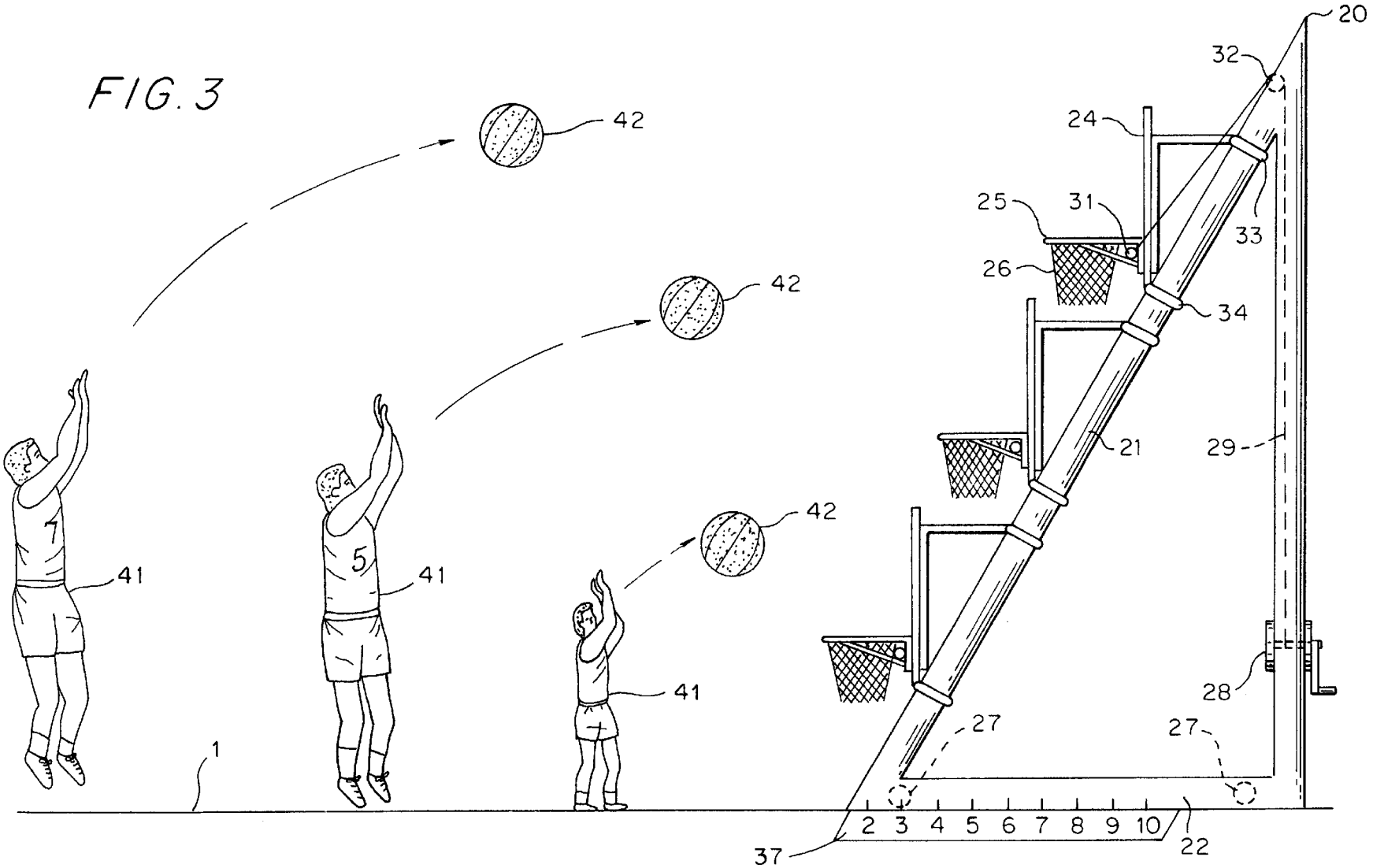
FIG. 3 shows an overall view of the non-floor mat apparatus aspects of the invention.
Figure 4:
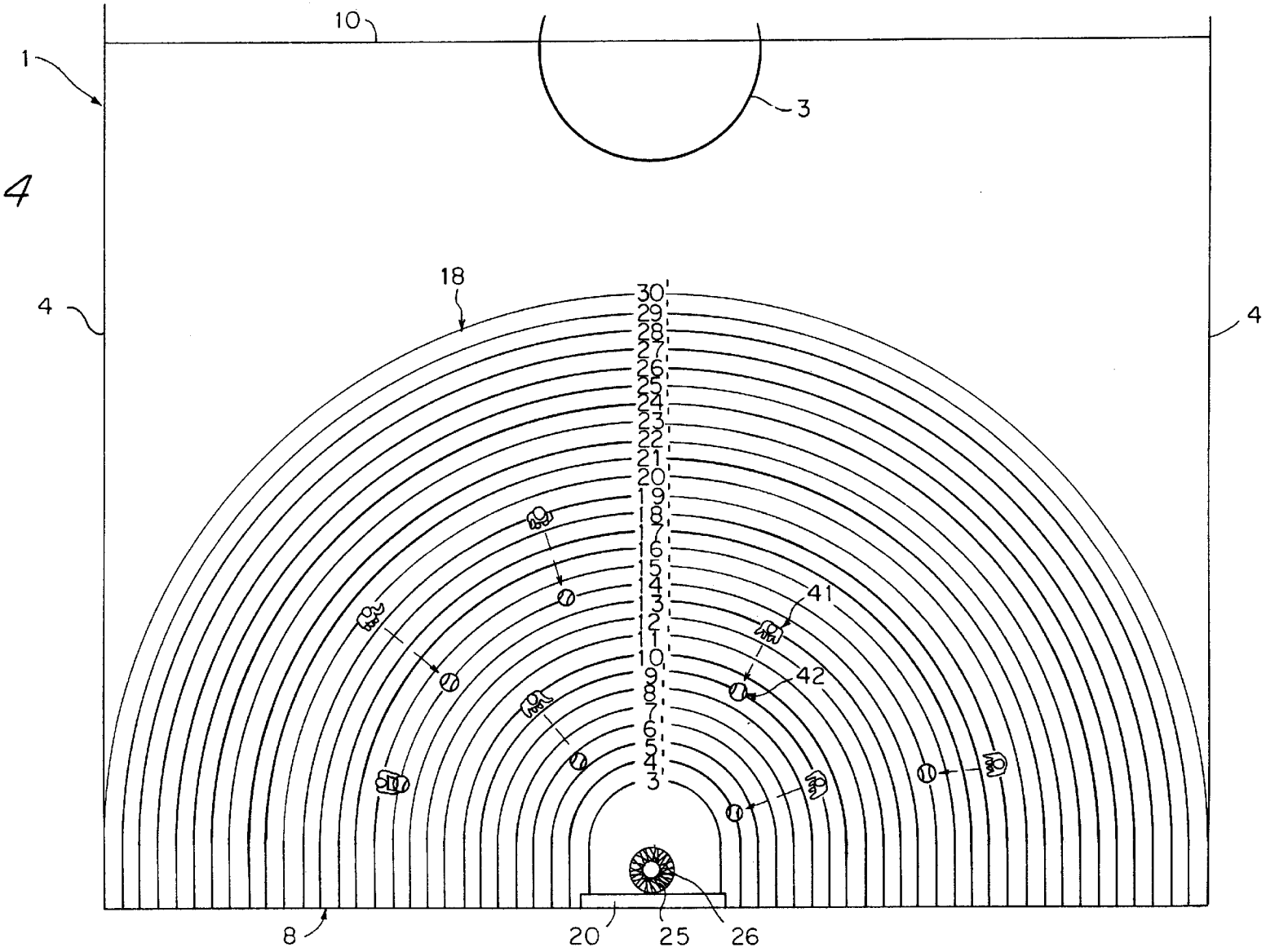
FIG. 4 shows a top plan view of the floor mat of the invention.
Figure 5:
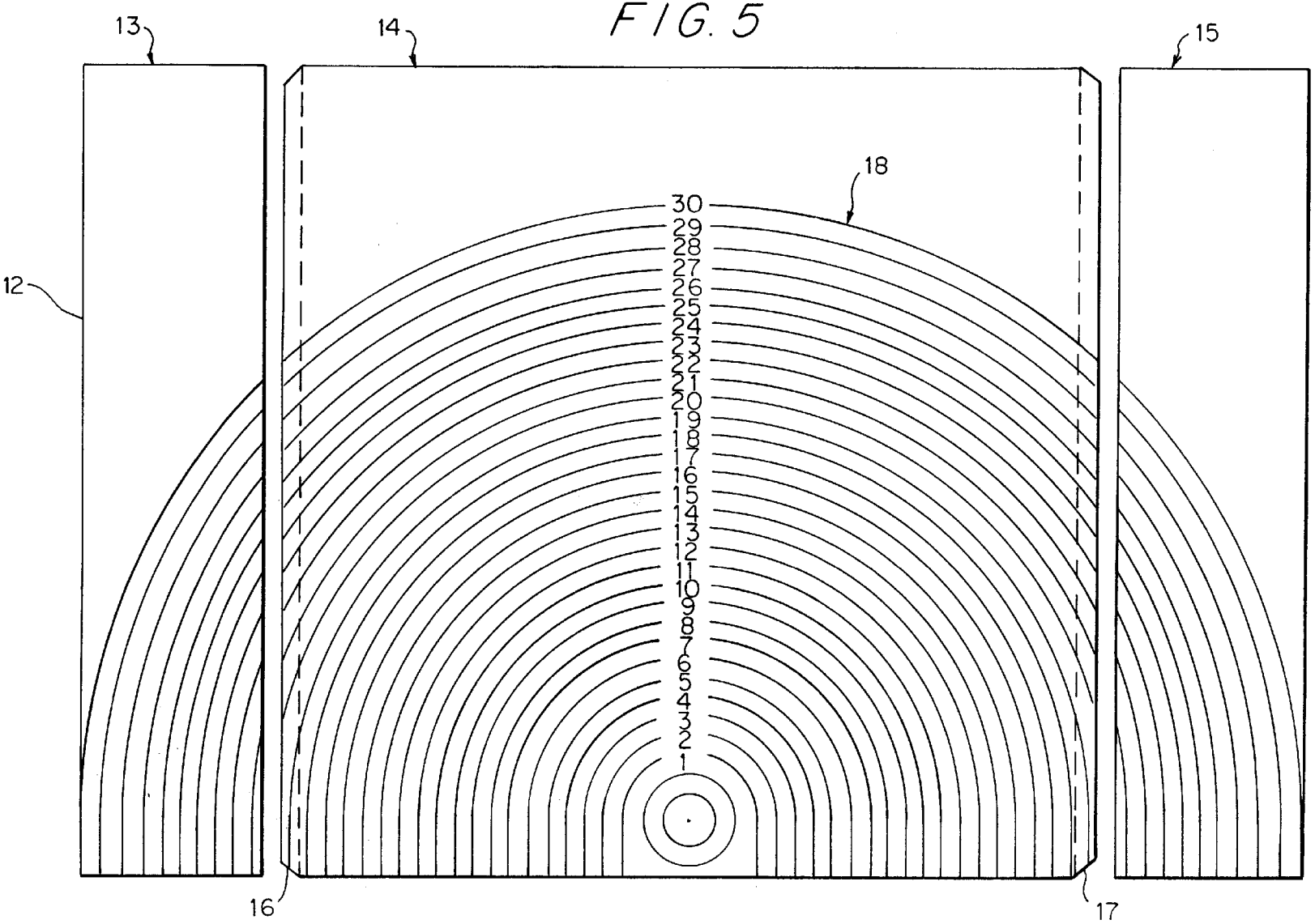
FIG. 5 shows another view of the floor mat of the invention.

Referring now to FIGS. 2 and 3, Applicant's basketball shooting skill development apparatus is made up of three main parts, namely a height adjustable goal or basket, as shown in FIGS. 2 and 5, a floor mat 12 and an automatic safety device which serves to securely maintain the height of the goal or basket in the event that the backboard should fall. The floor mat 12 is made up of three separate pieces 13, 14, 15, and each piece is made from tarpaulin or sailcloth fabric. FIG. 2 shows that the pieces are laid out flat such that two sections 16, 17 overlap the edges of the adjacent pieces 13, 15 and fit together seamlessly. The floor mat 12 replicates one half of the basketball court, with respect to placement and measurements of lines 2 and 9, and can be situated at either end of the court. As shown in FIGS. 2, 4 and 5, the mat 12 has each square foot of its floor space marked such that the best performance coordinates of the basketball trainee 41 can be determined and recorded. Discussion and explanation of performance coordinates will be provided hereafter.

The floor mat 12 is fifty square feet in area and has semi-circular distance markings 18 which radiate on a point from a vertical line passing through the hoop 6, as shown on FIG. 4. The markings 18 are spaced equidistantly from one to thirty feet from the goal or basket to enable the trainee 41 to follow a pre-coordinated line and shoot the basketball 42 as many times as desired, and from different places on the floor mat 12. The first two markings 18, that is the ones closest to the basket, form two separate complete circles. However, the first circle falls within the area of the hoop, while the second circle is slightly larger than the hoop. The center of each of these circles lies directly under the center of the hoop 25. An arc is drawn on the mat 12, radiating from the center of the hoop 25 and represents each foot of distance, up to thirty feet, from the center of the hoop 25.

Looking now at FIG. 2. To assemble the mat 12, the center section 14 is extended first. The right hand edge 17 of the center section 14 is folded outward and the right panel 15 is extended over the right edge 17 such that the markings of each arc appearing on the surface thereof align and produce one continuous arc. The left edge is then folded outward and the left panel 13 is extended over the left edge 16 of the center panel 14 while aligning the markings appearing thereon, thereby creating a total of 30 arcs, which match-up with similar markings on the other panels 14, 15.

The floor mat 12 has the corners of each square foot marked with an X as shown in FIG. 4. Since the floor mat 12 is the exact width of one half of the basketball court C, the edges of the floor mat 12 are also marked along the sides and at the end. The intersection of imaginary lines cross at a point, allowing a trainee to know exactly how far he or she is from the center of the hoop 25. In addition, half circles radiate from the hoop 25 outwardly to 30 feet. These half circles allow the trainee 41 to practice shooting from many different places on the court C, but always at the same distance from the hoop 25. By making use of the semi-circles and grid coordinates, a basketball trainer or coach can more effectively place players on the court for higher scoring during an actual basketball game.

FIG. 3 shows that the goal or basket incorporates a height adjustable backboard 24, a hoop 25, and a net 26, all of which are carried on a rigid and sturdy multipart frame 20. The frame 20 resembles two identical, laterally spaced apart right triangles. The frame 20 is made of any material capable of supporting the combined weight of the backboard 24, hoop 25 and net 26, as well as the various mounting elements that will be described later. In addition, the frame 20 must be able to withstand the physical abuse of repeated impact by a basketball. Such materials may be either metal, wood or an engineered thermoplastic, the selection being made with an eye toward cost efficiency. The vertical height of the hoop 25 can be adjusted to match the present height of the trainee 41 in order to achieve maximum training benefit, as will be discussed later. The backboard 24 is mounted on the sloped leg 21 of the frame 20. The sloped leg 21, which may also hereinafter be referred to alternatively as the "hypotenuse", allows adjustment in height of the backboard 24 and to also adds to the automatic height maintaining safety device which will be discussed later. As an additional safety feature, due to both the position of the backboard 24 and the incline of the leg 21, the backboard 24 will descend slowly toward the floor if a supporting cable 29 breaks or if a height adjusting winch 28 malfunctions, due to the fact that the leg 21 is indeed sloped. Each leg of the frame 20 has a solid triangular cross-section. This design offers the greatest amount of strength and rigidity. However, other cross-sectional shapes are conceivable, such as hollow tubular, solid tubular, hollow triangular, solid square, or hollow square, just to name a few.

Figure 6:
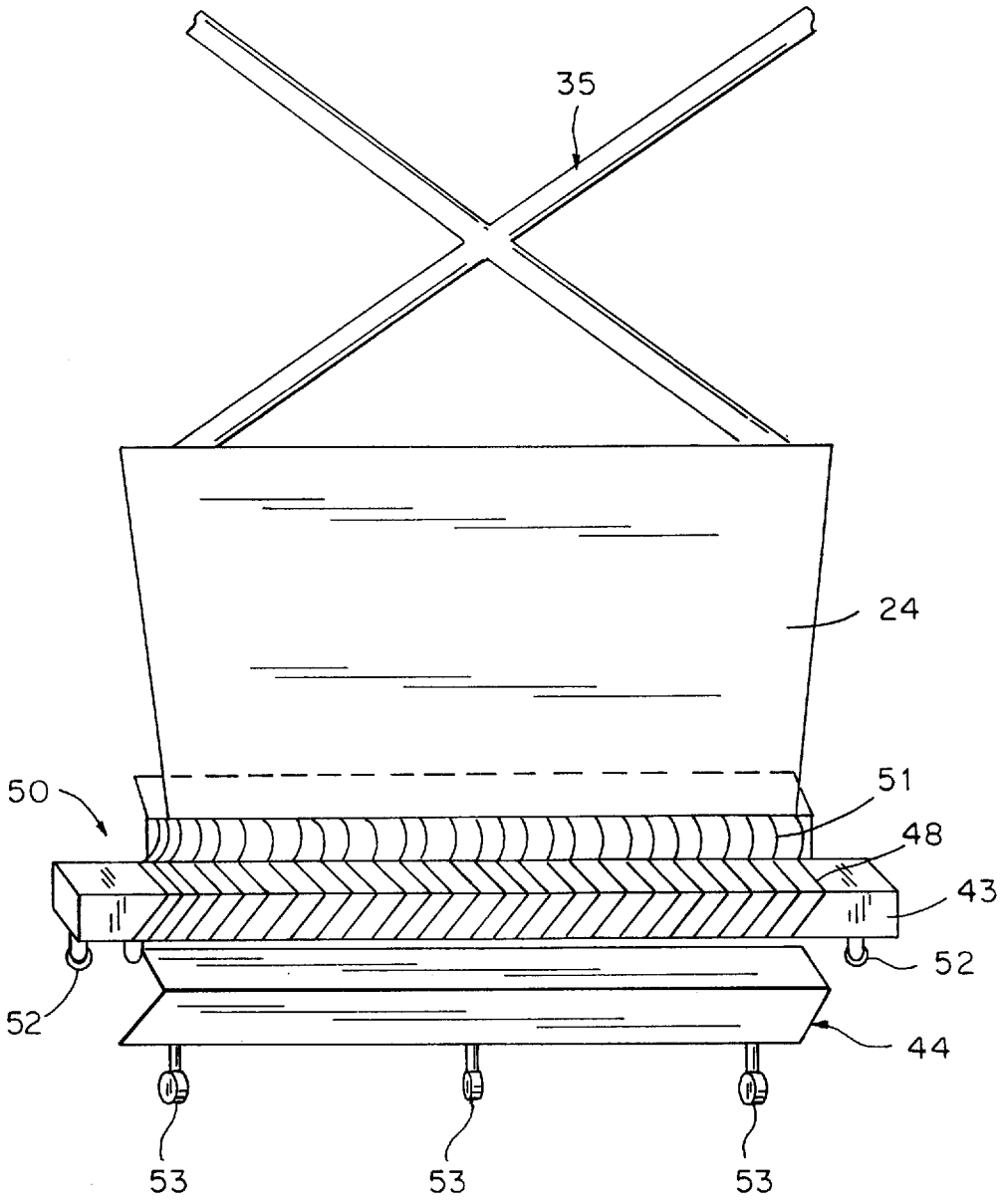
FIGS. 6 shows the automatic safety device component of the invention.

The automatic height maintaining safety device will now be discussed with reference to FIG. 6. The automatic safety device provided on the backboard 24 is in the form of a trough 50. The trough 50 includes bottom 48, a support which is hinged to the bottom 48, a breakaway portion 44, a fixed front portion 43, a front side, and a spring. The trough 50 supports the backboard 24 and serves as a fulcrum between the cable 29 and the pulley 32. Thus, if the cable 29 breaks while supporting the backboard 24, the front of the trough 50 is urged backward by the spring, which is attached to the front side and the bottom 48 of the trough 50, thereby causing the backboard 24 to fall onto the support, hence driving its front edge onto the sloped leg 21 and arresting further downward movement of the backboard 24. The cable 29 passes through eyebolts 53 fastened to the trough 50. The trough 50 is placed under the bottom edge of the backboard 24, with a six inch long metal strip (not shown) which is resting on the sloped leg 21 of the frame 20, and the trough 50 is held in place by U bolts 52 and by the weight of the backboard 24. The cable 29 passes through the trough 50 at a location to cause the metal strip (not shown) to tip upwardly, thereby lifting the weight of the backboard 24 off of the leg 21, thus allowing the backboard 24 to be drawn upwardly when tension is applied to the cable 29. The bottom of the backboard 24 rests on the sloped leg or hypotenuse 21, which forms a track for the backboard 24 support brackets 33, 34 to slide upon. The top of the backboard 24 is held by a cross-brace 35.

The height adjustment of the goal or basket is accomplished by the action of a support cable 29 and winch 28. The winch 28 includes a pawl and rachet mechanism (not shown) that serves to hold the backboard 24, and hence the hoop 25, at the height reached by the cable 29, that is to say, the height deemed to provide maximum benefit to the trainee 41. The weight of the goal or basket is supported against the force of gravity by the cable 29, which is in turn attached to the winch 28. The cable 29 leaves the winch 28 and threads over a pulley 32, and connects to the backboard 24 at a point 31. When the goal or basket is in any position, it relies on the strength of the leg 21 for support. When the cable 29 is tightened by the winch 28, the weight of the goal or basket will force the hinged front-end of the trough 50 more firmly against the backboard. The metal tongue (not shown) which protrudes from the trough 50 onto the top of the leg 21, will flatten itself on the leg 21 enough to allow the backboard 24 to be raised or lowered. The trough 50 supports the backboard 24 when the pawl and ratchet mechanism is functioning properly, and serves as an automatic braking device to prevent unintended descent of the backboard 24 should the cable 29 break.

Since the backboard 24 is raised or lowered via the winch 28. The winch 28 may be either cranked manually via a handle 36, or may be moved by a suitable electric motor (not shown). The winch 28 can locate the backboard 24 at any height, from three feet to ten feet. The backboard 24 is held at the selected height by the latch whose tip is placed to catch in the teeth of the pawl. The pawl is essentially a nut disposed at the base of the winch handle 36, which when properly engaged serves to prevent undesirable reverse movement of the backboard 24. In preparation for practice, the trainee 41 merely drops the backboard 24 until the hoop 25 is at his or her chest level. The trainee 41 may then stand at a distance from the hoop 25 that enables him or her touch the center of the hoop 25 with each hand. The backboard 24 is drawn up the leg or hypotenuse 21 by the application of tension to the cable 29, supplied by the winch 28.

A discussion of storing and transporting the apparatus will now be given with reference to FIG. 5. First, the floor mat 12 is dismantled into its basic three sections 13, 14, 15. The center section 14 having the two-foot wide edges 16, 17, is removed from the other overlapping sections 13, 15, respectively. There is an extra length beyond the size of the basketball court to facilitate rolling of the mat 12 onto one eighteen foot long spindle 55 and two sixteen foot spindles 56. The floor mat 12 is then wound on the spindles. The center section 14 is eighteen feet wide, and with its two edges 16, 17 each measuring one foot in width, the total width of the center section 14 is twenty feet. The side panels 13, 15 are each sixteen feet wide, and the length of each panel 13, 14, 15 is at least fifty-five feet to facilitate rolling the mat 12 onto the spindles. The mat 12, when rolled onto the spindles, is placed on a tray (not shown) which is located at the bottom of the frame 20. To remove the mat 12, as well as the goal, from the basketball court, a ratchet is inserted into the center of each spindle and turned to draw each respective section onto its spindle. The process of pulling the sections onto the spindles is assisted by rollers which are embedded in the loops of the spindle guide. The edges 16, 17 of the center section 14 must be folded before the mat 12 is rolled onto the carrying tray of the frame 20. When the carrying rack is loaded, one person can easily roll the entire apparatus off the court because the frame 20 is provided with rollers 30.

Figure 7:
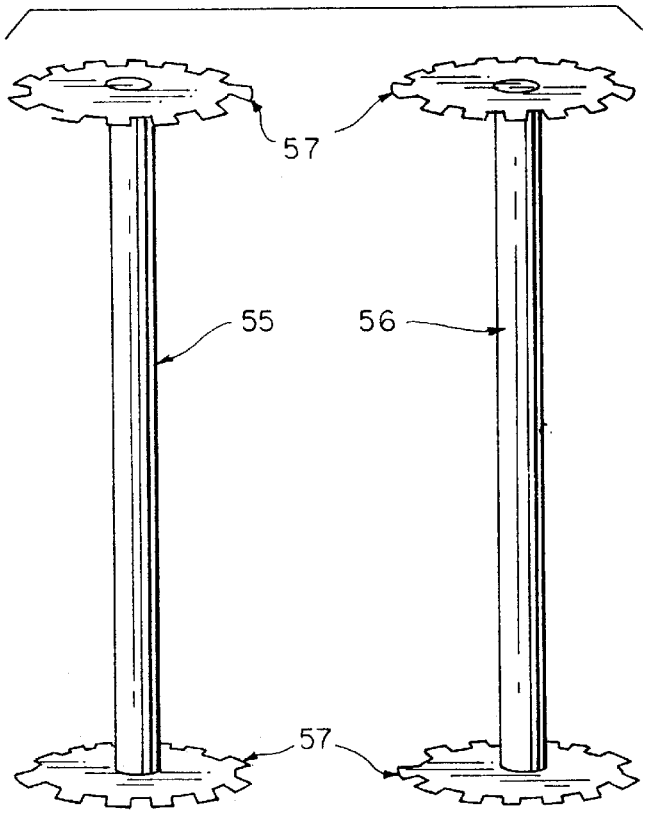
FIG. 7 shows the spindles component of the invention.
Figure 8:
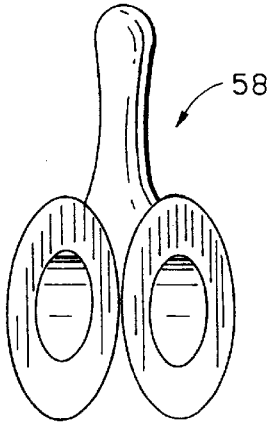
FIG. 8 shows the rollers component of the invention.

FIG. 7 shows the ratchet and the spindles 55, 56 which are used to store the panels 13, 14, 15 which make up the mat 12. The ratchets 57 are on the end of each spindle 55, 56, and can be cranked manually or by a powered apparatus (not shown), such as a pneumatic or electric drive motor, in order to draw each panel 13, 14, or 15 of the mat 12 onto its respective spindle 55 or 56. The rollers 58 assist in pulling the panels 13, 14, 15 onto the spindles 55, 56. The rollers 58 are embedded in the loops of a spindle guide (not shown). The edges 16, 17 of the center panel 14 must be folded before that section is rolled onto its spindle 55. Spindle 55 serves to store the center panel 14, and spindle 56 serves to store the side panels 13, 15.

A discussion of Applicant's basketball shooting skill development method will now be provided with reference to FIG. 4, realizing that at its regulation height, the hoop 25 is ten feet from the floor of the court. In order to achieve a two point score, the shooting distance to the hoop 25 can be anywhere from zero feet to twenty feet, as measured linearly from the location of the trainee 41 to the hoop 25. Therefore, according to Applicant's method, the hoop 25 remains at a trainee's chest level until he or she is far enough from the hoop 25 to equal a foot of distance for each six inches of height of the hoop 25 from the floor. For instance, if chest level for a respective trainee 41 is four feet, the hoop 25 should be placed 48 inches high, divided by six feet, eight groups of six inches and eight feet from the hoop 25 before the backboard 24 should be raised.

Training begins with the hoop 25 lowered to the level of the chest of the trainee 41. A right handed trainee stands with his or her right shoulder addressing the hoop 25. Similarly, a left handed trainee stands with his or her left shoulder addressing the hoop 25. The trainee 41 then attempts to make one hundred baskets. Training proceeds around the circle until the trainee has attempted one hundred baskets. A record of how many baskets are successfully completed is maintained. From the first circle, which may conceivable be between two of the drawn lines, the basketball 42 should be dropped through the hoop one hundred times. The trainee 41 then steps back to the first drawn line and repeats the first step. Note that for each shot, the trainee 41 concentrates on and aims for the middle of the hoop 25 in order to get a feel for the center of the hoop 25. The trainee 41 then moves to the first drawn circle and shoots the basketball 42 until one hundred baskets have been shot. Thereafter, the hoop is raised six inches each time that the trainee moves backward one foot. Trainee 41 moves to the next semi-circle and continues to shoot the basketball 42 until he or she has reached a distance from the hoop that requires the trainee 41 to expend greater effort in order to get the basketball 42 through the hoop 25. In this manner, the trainee 41 moves from semi-circle to semi-circle, shooting the ball 42 ever so deliberately so that he or she never fails to get it into the hoop 25.

A record is kept of every attempted shot with respect to whether or not the basketball 42 went through the hoop 25. When the trainee 41 has reached a distance of twenty feet from the hoop 25, the hoop 25 will be the regulation height of 10 feet from the floor. The trainee 41 then works back to the hoop 25 without lowering it, one hundred shots for each foot, until he or she must make a lay-up shot. For shooting practice that is designed to go beyond 20 feet, the training method is the same except that the hoop 25 is raised four inches for each foot moved backward. Training continues by trainee 41 with movement in a circle around the hoop 25 and dropping the basketball 42 into the hoop 25 from every position on the mat 12.

Careful review of FIG. 3 reveals that, the base 22 of the frame 20 will always protrude onto the basketball court, thereby discouraging players to come near it. The distance that the base 22 extends onto the court is indicated by a measuring tape 37 placed along the exposed edge of the base 22. Markings on the measuring tape indicate the distance onto the court, as well as giving an indication of the height of the hoop 25 at any given moment. The markings are calibrated in feet. For example, when the measuring tape 37 denotes six feet, as measured from the end line, the hoop is six feet above the surface of the court.

The frame 20 is rolled to and from the basketball court on the rollers 27 which are jacked, that is to say, raised and/or lowered into place, by pushing a handle (not shown) until the handle is parallel to the base 22. The handle and supports are opposite angular ends which pivot on a bushing and is held in place by a wheel handle hook.

While Applicant has presented a preferred embodiment for purposes of explanation, it will be understood by persons having ordinary skill in the art that variations and changes may be made without departing from the scope and spirit of the invention, which is here now recited in the following claims and equivalents thereto.

I claim:

1. An apparatus for developing basketball shooting skill in a basketball trainee, comprising:

a movable rigid frame, a basketball goal and backboard assembly connected to a height adjusting mechanism, said mechanism including a cable and winch assembly connected to said movable rigid frame; a carrier borne on wheels, said carrier supporting said movable rigid frame;

a floor mat bearing basketball court location indicia;

one or more spindles connected to said carrier, each including ratcheted ends, each spindle adapted to receive said floor mat; and whereby said basketball goal and backboard assembly is adjusted in height by said cable and winch assembly to match a selected height suitable for said trainee standing upon any of the location indicia borne on said floor mat; whereby said one or more spindles, said floor mat, said movable rigid frame and said basketball goal and backboard all being supported by and transportable by said carrier.

2. The apparatus of claim 1, wherein said movable rigid frame comprises two laterally spaced apart, right triangularly shaped elements, the planes of each element being parallel to each other, the spacing of said triangularly shaped elements being maintained by a cross-brace attached to each of said elements, the sloped leg or hypotenuse of each of said elements supporting said basketball goal and backboard assembly in an upright position, and said sloped leg or hypotenuse imposeable upon said basketball court.

3. The apparatus of claim 1, wherein said movable rigid frame includes positioning indicia.

4. The apparatus of claim 1, wherein said height adjusting mechanism further includes an automatic height maintaining safety device, said safety device being capable of preventing rapid decent of said basetball goal and backboard assembly wherein when said cable breaks or is sufficiently slack, the safety device causes the basketball goal and backboard assembly to contact said sloped leg or hypotenuse thereby breaking the rapid descent of the basketball goal and backboard assembly.

5. The apparatus of claim 1, wherein said wheeled carrier is integral with said movable frame, and said wheels are retractable.

6. The apparatus of claim 1, wherein said floor mat comprises a plurality of discrete sections, which when joined together cover an area of a regulation basketball court extending in length from the center line to an end line, and in which between the sidelines of said court.

7. The apparatus of claim 6, wherein said movable rigid frame comprises structural elements at least one of which has a triangular cross-section.

8. The apparatus of claim 6, wherein said movable rigid frame comprises structural elements at least one of which has a square cross-section.

9. The apparatus of claim 6, wherein said movable rigid frame comprises structural elements at least one of which has a circular cross-section.

10. A method for developing basketball shooting skill in a basketball game trainee, comprising the steps of:

I. placing a basketball goal at a vertical height approximately equal to the height of a shoulder of said trainee;

II. selecting iteratively, a first position from among a plurality of equally spaced positions concentrically arranged around said goal, said positions extending outwardly therefrom, each position forming a concentric circle or semicircle terminating at a baseline of said basketball goal, the geometric center of each respective concentric circle or semicircle falling along a vertical line passing through the center of said basketball goal and wherein said positions being indicated by a floor mat covering one half of a basketball court;

III. directing said basketball trainee to both stand on a first selected position and shoot a basketball into said basketball goal;

IV. recording the outcome of a shot;

V. repeating said method steps II, III and IV for the same first selected position until about one hundred successful basketball goals are shot by said trainee of said position; and VI. selecting a second position from among the plurality of positions and repeating steps III, IV and V.

11. The method of claim 10 further comprising;

VII. selecting a third position from among the plurality of positions and repeating steps III, IV and V.

12. An apparatus for developing basketball shooting skill in a basketball trainee, comprising:

a manually movable support means; backboard assembly including a basketball goal, means for increasing or decreasing the height of said backboard assembly attached to said movable support means, means for securing said backboard assembly at a desired height, and means for preventing uncontrolled descent of said backboard assembly functioning in conjunction with said means for increasing or decreasing the height to maintain said desired height, said backboard assembly being supported by said support means and movable therewith; removable planar location indicia means for covering that area of a basketball court occupying the space between the sidelines and extending from the centerline to an end line thereof; and storage means for said location indicia means, said storage means in contact with and adapted for movement along with said movable support means and said backboard assembly, whereby said backboard assembly is adjustable in height by the means for increasing or decreasing the height in coordination with basketball shooting attempts of said trainee positioned upon any location indicia appearing on said location indicia means, to successfully shoot a basketball into said basketball goal.

13. A method for developing basketball shooting skill in a basketball game trainee with a flexible basketball court floor covering and an adjustable basketball goal and backboard apparatus, the adjustable basketball goal and backboard apparatus being movable, said apparatus comprising an elevation selecting means for changing the height of a basketball goal, means for maintaining a selected elevation, and means for preventing the rapid descent of said basketball goal, said apparatus further comprising means for storing said floor covering, the method comprising the steps of first placing a basketball goal at a vertical height approximately equal to the height of a shoulder of said trainee; second, selecting iteratively, a first position from among a plurality of equally spaced positions concentrically arranged around said goal, said positions extending outwardly therefrom, each position forming a concentric circle or semicircle terminating at a baseline of said basketball goal, the geometric center of each respective concentric circle or semicircle falling along a vertical line passing through the center of said basketball goal and wherein said positions being indicated by a floor mat covering one half of a basketball court; third, directing said basketball trainee to both stand on a first selected position and shoot a basketball into said basketball goal; fourth, recording the outcome of a shot; fifth, repeating said method steps II, III and IV for the same first selected position until about one hundred successful basketball goals are shot by said trainee of said position; and sixth, selecting a second position from among the plurality of positions and repeating steps III, IV and V.

* * * * *